US006139805A

United States Patent [19]

Nagato et al.

[11] Patent Number: 6,139,805

[45] **Date of Patent: *Oct. 31, 2000**

[54] FLUIDIZED-BED REACTOR

[75] Inventors: Shuichi Nagato; Takahiro Oshita, both of Yokohama, Japan

[73] Assignee: Ebara Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/752,440

[22] Filed: Nov. 14, 1996

[30] Foreign Application Priority Data

Nov. 15, 1995 [JP] Japan ..... 7-320967

[51] Int. Cl.[7] ..... B01J 8/18

[52] U.S. Cl. ..... 422/143; 422/145; 422/146

[58] Field of Search ..... 422/143, 145, 422/146

[56] References Cited

U.S. PATENT DOCUMENTS

| | | | |
|---|---|---|---|
| 4,517,162 | 5/1985 | Moss | 422/143 |
| 5,156,099 | 10/1992 | Ohshita et al. . | |
| 5,299,532 | 4/1994 | Dietz | 422/146 |
| 5,313,913 | 5/1994 | Ohshita et al. . | |
| 5,332,553 | 7/1994 | Hyppanen | 422/143 |
| 5,341,766 | 8/1994 | Hyppanen | 422/146 |
| 5,365,889 | 11/1994 | Tang | 422/146 |
| 5,508,007 | 4/1996 | Vidal et al. | 422/146 |
| 5,510,085 | 4/1996 | Abdulally | 422/143 |
| 5,513,599 | 5/1996 | Nagato et al. | 422/146 |

FOREIGN PATENT DOCUMENTS 5-172301 7/1993 Japan .

OTHER PUBLICATIONS

"The Midwest Power DMEC–2 Advanced PCFB Demonstration Project Ahlstrom Pyroflow Advanced Pressurized Circulating Fluidized Technology", S.J. Provol & S. Ambrose, 1993 U.S.A., P948.

*Primary Examiner*—Timothy McMahon

*Attorney, Agent, or Firm*—Wenderoth, Lind & Ponack, L.L.P.

[57] ABSTRACT

A fluidized-bed reactor is suitable for uniformly oxidizing, i.e. combusting or gasifying, solid material containing combustible material and incombustible material, and for stably recovering thermal energy from the oxidized combustible material while smoothly discharging the incombustible material. The fluidized-bed reactor comprises a plurality of fluidizing gas diffusion devices disposed at a bottom of a fluidized-bed furnace for imparting different fluidizing speeds to the fluidized medium in a fluidized bed in the fluidized-bed furnace to form an upward flow of the fluidized medium in a fluidizing region with a substantially high fluidizing speed of the fluidized medium and a descending flow of the fluidized medium in a fluidizing region with a substantially low fluidizing speed of the fluidized medium. A plate-like thermal energy recovery device is disposed in the fluidizing region with the substantially low fluidizing speed of the fluidized medium and has a heat recovery surface extending vertically.

12 Claims, 11 Drawing Sheets

FLUIDIZED-BED REACTOR

BACKGROUND OF THE INVENTION

1. Field of the Invention

The present invention relates to a fluidized-bed reactor, and more particularly to a fluidized-bed reactor for uniformly oxidizing, i.e. combusting or gasifying, solid material containing combustible material and incombustible material, such as industrial wastes, municipal wastes, or coal, and for stably recovering thermal energy from the oxidized combustible material while smoothly discharging the incombustible material.

2. Description of the Prior Art

As the economy develops, general wastes produced as a result of economic activities are increasing at a rate of 3 to 4% each year, and reach an amount of 50 million tons a year in Japan. An analytic study indicates that 82% of such general wastes are combustible material and correspond to 7.2 million tons in terms of oil.

Industrial wastes keep on increasing year after year. Therefore, plastics including incombustible material, which have heretofore been handled as unsuitable material for combustion and filled in moats, will have to be incinerated in the future because of a limited number of areas available for disposal of such plastics. Combustible industrial wastes including waste oil and waste plastics amount to 17 million tons a year, and should be treated as a fuel rather than wastes because they can produce heat at a ratio of 3000 kcal/kg.

However, it is difficult to stably combust the solid combustible material to utilize its energy because the solid combustible material is available in a wide variety of natures and configurations and contains a large quantity of incombustible material of indeterminate shape mixed therewith. Thus, effective utilization of energy recoverable from general and industrial wastes has not been practiced.

For effectively utilizing energy recoverable from general and industrial wastes, there have been developed a variety of systems for recovering thermal energy from the general and industrial wastes through oxidization including gasification and incineration thereof. Among those developed systems, there is a fluidized-bed incinerator or a fluidized-bed boiler that has been expected to be used as a system capable of stably recovering thermal energy by uniformly combusting solid material containing combustible material and incombustible material while smoothly discharging incombustible material. However, such a fluidized-bed incinerator or a fluidized-bed boiler has been disadvantageous for the following reasons:

When a waste material is combusted in a bubbling type fluidized bed, the waste material cannot uniformly and stably be combusted because solid particles flow only vertically and are not dispersed sufficiently in the bubbling type fluidized bed. The incombustible material whose specific gravity is larger than the fluidized medium is deposited over a wide range on the bottom of the furnace. As a result, it is difficult to discharge the incombustible material from the furnace, and the incinerator or the boiler cannot be operated in a stable condition.

In order to solve the above problems of the simple bubbling type fluidized-bed, there have recently been proposed systems for generating a circulating flow in an enriched fluidized bed with varying fluidizing speeds of the fluidized medium to thereby mix and disperse the solid material to be incinerated for stable combustion.

The solid material to be incinerated by such proposed systems includes various material such as waste tires.

Incombustible material in the form of wires produced when waste tires are combusted tends to be deposited on the bottom of the fluidized bed and is liable to be entangled with heat transfer tubes, and hence fluidization of the fluidized medium is not carried out smoothly, resulting in malfunction of the furnace. No effective incineration process has heretofore been available for industrial wastes including incombustible material in the form of wires, such as waste tires.

For incinerating waste material, it is necessary to reduce NOx and other toxic substances produced when the waste material is combusted, to prevent a thermal energy recovery device from being corroded in a reducing atmosphere, and to discharge incombustible material smoothly. However, there have not been available in the art any apparatus which can meet all of the above requirements.

SUMMARY OF THE INVENTION

It is therefore an object of the present invention to provide a fluidized-bed reactor which is capable of uniformly oxidizing, i.e. combusting or gasifying, solid material containing combustible material and incombustible material, and stably recovering thermal energy from the oxidized incombustible material while smoothly discharging various incombustible material such as wires.

According to an aspect of the present invention, there is provided a fluidized-bed reactor for oxidizing combustible material containing incombustible material in a fluidized-bed furnace having a fluidized medium therein, comprising: a plurality of fluidizing gas diffusion devices disposed at a bottom of the fluidized-bed furnace for supplying a fluidizing gas, and for imparting different fluidizing speeds to the fluidized medium in a fluidized bed in the fluidized-bed furnace to form an upward flow of the fluidized medium in a fluidizing region with a substantially high fluidizing speed of the fluidized medium and a descending flow of the fluidized medium in a fluidizing region with a substantially low fluidizing speed of the fluidized medium; and a plate-like thermal energy recovery device disposed in the fluidizing region with the substantially low fluidizing speed of the fluidized medium, the plate-like thermal energy recovery device having a heat recovery surface extending vertically.

According to the present invention, there are provided a first diffuser plate for imparting a substantially relatively low fluidizing speed to the fluidized medium and a second diffuser plate for imparting a substantially relatively high fluidizing speed to the fluidized medium at a bottom of the fluidized-bed furnace. Fluidizing gas chambers are provided below the first and second diffuser plates, respectively. The fluidizing gas is introduced into the fluidizing gas chambers through connectors. The fluidizing gas in the fluidizing gas chamber is supplied through a number of nozzles defined in the first diffuser plate into the fluidized-bed furnace at a relatively low fluidizing gas velocity, thus forming a weak fluidizing region of the fluidized medium above the first diffuser plate. The fluidizing gas in the fluidizing gas chamber is supplied through a number of nozzles defined in the second diffuser plate into the fluidized-bed furnace at a relatively high fluidizing gas velocity, thus forming an intense fluidizing region of the fluidized medium above the second diffuser plate. Air, air from which nitrogen is removed, oxygen-enriched air, oxygen, water vapor and mixture of at least two gases of the above gases are preferably used as a fluidizing gas. Any other gas may be used as a fluidizing gas.

In the weak fluidizing region, a descending flow of the fluidized medium is developed, and in the intense fluidizing region, an upward flow of the fluidized medium is developed. As a result, a circulating flow in which the fluidized medium moves upwardly in the intense fluidizing region and downwardly in the weak fluidizing region is created in the fluidized bed. In this manner, a plurality of the intense fluidizing region and the weak fluidizing region are alternately formed in the fluidized-bed furnace, and a plate-like heat transfer unit is disposed in the weak fluidizing region of the fluidized medium.

A combustible material is supplied into the weak fluidizing region in which the plate-like heat transfer unit is not installed, and the combustible material is combusted in a reducing atmosphere with a small amount of oxygen while it is swallowed up by the circulating flow of the fluidized medium. The combustible material is then moved to the intense fluidizing region of the fluidized medium with the circulating flow, and it is sufficiently combusted in an oxidizing atmosphere in the intense fluidizing region of the fluidized medium. Thereafter, the fluidized medium which is heated to a high temperature is moved with the subsequent circulating flow toward the adjacent weak fluidizing region where the fluidized medium descends with the descending flow and transfers heat to the plate-like heat transfer unit installed in the weak fluidizing region. The weak fluidizing region, in which the plate-like heat transfer unit is provided, has an oxidizing atmosphere because the fluidized medium in which the combustible material has sufficiently been combusted in the intense fluidizing region flows into the weak fluidizing region. Therefore, the plate-like heat transfer unit is not subject to corrosion in a reducing atmosphere. Since the plate-like heat transfer unit is provided in the weak fluidizing region, it is subject to less wear.

The incombustible material which is contained in the supplied solid material and may be in the form of wires is not liable to be entangled with the heat transfer unit because the heat transfer unit has a plate-like shape. The fluidized-bed furnace can therefore operate continuously without malfunction.

The plate-like heat transfer unit comprises a plurality of adjacent heat transfer tubes extending in turns parallel to each other and joined to each other by fins. The heat transfer tubes jointly provide a single thermal energy recovery surface. The plate-like heat transfer unit thus constructed has a wide surface area available for heat transfer. Since each of the heat transfer tubes may be of a relatively short length, any pressure loss therein is relatively small.

According to one aspect of the present invention, a partition wall is provided between a weak fluidizing region in which the heat transfer unit is provided and an intense fluidizing region, and communicating ports are provided above and below the partition wall to provide communication between the intense fluidizing region and the weak fluidizing region. The partition wall partitions the interior space of the fluidized-bed furnace into a thermal energy recovery chamber which houses the heat transfer unit, and a main combustion chamber which is free of the heat transfer unit.

Further, according to another aspect of the present invention, a plurality of fluidizing regions in which different fluidizing speeds are imparted to the fluidized medium, respectively are alternately provided in the fluidized-bed furnace, and a plate-like heat transfer unit is provided in the weak fluidizing region in which a substantially low fluidizing speed is imparted to the fluidized medium and an upward flow of the fluidized medium is created.

Further, according to still another aspect of the present invention, a fluidizing gas diffusion device for imparting a substantially high fluidizing speed to the fluidized medium is provided between two fluidizing gas diffusion device for imparting a substantially low fluidizing speed to the fluidized medium, and the thermal energy recovery device is provided in one of the weak fluidizing regions. An incombustible material discharge port is provided between the diffusion device for imparting a substantially high fluidizing speed to the fluidized medium and the diffusion device for imparting a substantially low fluidizing speed to the fluidized medium.

According to the above arrangement, a combustible material is supplied into one of the weak fluidizing regions, and the combustible material is combusted in a reducing atmosphere in the weak fluidizing region, and then combusted in an oxidizing atmosphere in the intense fluidizing region in which a relatively high fluidizing speed is imparted to the fluidized medium. The combustible material is combusted in a combination of such reducing and oxidizing atmospheres, thus discharging emission gases with improved qualities, e.g., reduced NOx. The thermal energy recovery device is provided in the other of the weak fluidizing regions. The weak fluidizing region, in which the thermal energy recovery device is provided, has an oxidizing atmosphere because the fluidized medium in which the combustible material has sufficiently been combusted in the intense fluidizing region flows into the weak fluidizing region. Therefore, the thermal energy recovery device is not subject to corrosion in a reducing atmosphere. The incombustible material contained in the supplied solid material is discharged from the incombustible material discharge port before reaching the thermal energy recovery device because the intense fluidizing region and the incombustible material discharge port are provided between the combustible supply port and the thermal energy recovery device. Even if some incombustible material happens to reach the heat transfer surface of the thermal energy recovery device, since the heat transfer surface is of a planar shape, the incombustible material which may be in the form of wires is not liable to be entangled with the thermal energy recovery device. Therefore, the incombustible material is carried with the circulating flow back to the incombustible material discharge port and is discharged therefrom.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
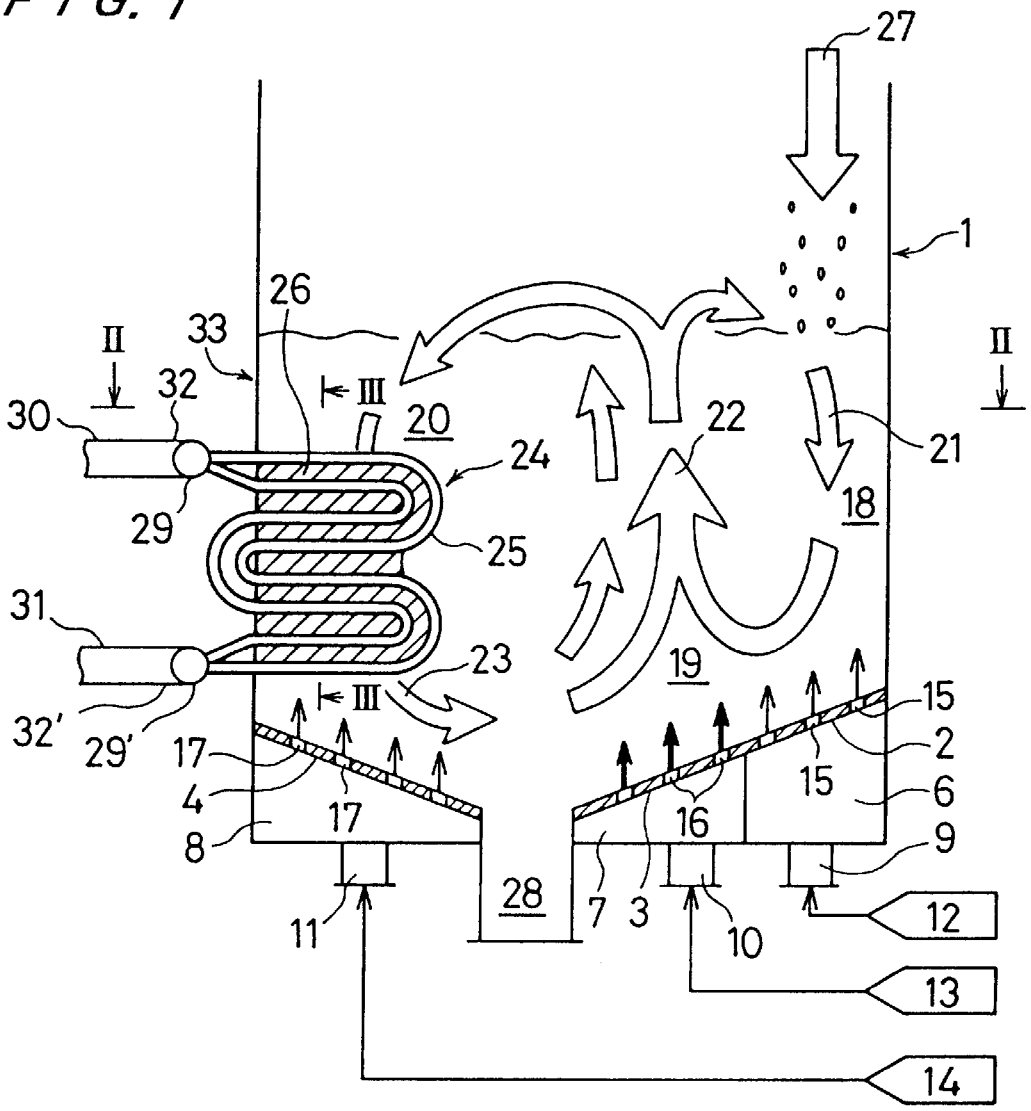
FIG. 1 is a vertical cross-sectional view of a fluidized-bed reactor according to a first embodiment of the present invention.

Like or corresponding parts are denoted by like or corresponding reference numerals throughout views. A fluidized-bed reactor according to embodiments of the present invention will be described below with reference to FIGS. 1 through 14. In the embodiments described below, a fluidized-bed combustion apparatus will be described as one example of the fluidized-bed reactor.

FIGS. 1 through 5 show a fluidized-bed combustion apparatus according to a first embodiment of the present invention.

As shown in FIG. 1, the fluidized-bed combustion apparatus according to the first embodiment comprises a fluidized-bed furnace 1 which houses a first diffuser plate 2 for imparting a substantially low fluidizing speed to a fluidized medium, a second diffuser plate 3 for imparting a substantially high fluidizing speed to the fluidized medium, and a third diffuser plate 4 for imparting a substantially low fluidizing speed to the fluidized medium at the bottom of the furnace. The first diffuser plate 2 is connected to the second diffuser plate 3, and the second diffuser plate 3 is spaced horizontally from the third diffuser plate 4. An incombustible material discharge port 28 is defined between the second diffuser plate 3 and the third diffuser plate 4. The third diffuser plate 4, and the first and second diffuser plates 2 and 3 are inclined downwardly toward the incombustible material discharge port 28. A fluidizing gas chamber 6 is defined below the first diffuser plate 2, a fluidizing gas chamber 7 is defined below the second diffuser plate 3, and a fluidizing gas chamber 8 is defined below the third diffuser plate 4. Connectors 9, 10 and 11 are connected to the fluidizing gas chambers 6, 7 and 8, respectively for introducing fluidizing gas 12, 13 and 14 therethrough into the gas chambers 6, 7 and 8. In this embodiment, the fluidizing gas 12, 13 and 14 is composed of air.

The first diffuser plate 2 has a plurality of nozzles 15 defined therein which communicate with the fluidizing gas chamber 6 and are open toward a fluidizing region of the fluidized medium. The second diffuser plate 3 has a plurality of nozzles 16 defined therein which communicate with the fluidizing gas chamber 7 and are open toward a fluidizing region of the fluidized medium. The third diffuser plate 4 has a plurality of nozzles 17 defined therein which communicate with the fluidizing gas chamber 8 and are open toward a fluidizing region of the fluidized medium.

The fluidized-bed furnace 1 has a polygonal vertical side wall 33 extending upwardly, and thus the fluidized-bed furnace 1 has a rectangular shape when viewed in plan.

In the fluidized-bed furnace 1, the fluidized medium of incombustible particles such as sand is blown upwardly into a fluidized state by the fluidizing gas 12, 13 and 14 which is introduced into the fluidized-bed furnace 1 from the first, second and third diffuser plates 2, 3 and 4, thereby forming a fluidized bed in the fluidized-bed furnace 1. To be more specific, the fluidizing gas in the fluidizing gas chamber 6 is supplied through a number of nozzles 15 defined in the first diffuser plate 2 into the fluidized-bed furnace 1 at a relatively low fluidizing gas velocity, thus forming a weak fluidizing region 18 of the fluidized medium above the first diffuser plate 2. In the weak fluidizing region 18, the fluidized medium produces a descending flow 21. The fluidizing gas in the fluidizing gas chamber 8 is supplied through a number of nozzles 17 defined in the third diffuser plate 4 into the fluidized-bed furnace 1 at a relatively low fluidizing gas velocity, thus forming a weak fluidizing region 20 of the fluidized medium above the third diffuser plate 4. In the weak fluidized-bed region 20, the fluidized medium produces a descending flow 23. The fluidizing gas in the fluidizing gas chamber 7 is supplied through a number of nozzles 16 defined in the second diffuser plate 3 into the fluidized-bed furnace 1 at a relatively high fluidizing gas velocity, thus forming an intense fluidizing region 19 of the fluidized medium above the second diffuser plate 3. In the intense fluidizing region 19, the fluidized medium produces an upward flow 22. As a result, two circulating flows in which the fluidized medium moves upwardly in the intense fluidizing region 19 and downwardly in the weak fluidizing regions 18 and 20 are created in the fluidized-bed.

A thermal energy recovery device for recovering thermal energy from the fluidized-bed is disposed in the weak fluidizing region 20 above the third diffuser plate 4. The thermal energy recovery device comprises a plurality of horizontally spaced, parallel or plate or panel shaped heat transfer units 24 (see also FIG. 2), each of which extends vertically.

When a combustible material 27 is supplied from a supply port (not shown) downwardly into the weak fluidizing region 18, the combustible material 27 is introduced into the weak fluidizing region 18 with the descending flow 21, and thermally decomposed and combusted in a reducing atmosphere with a small amount of oxygen in the weak fluidizing region 18. Then, the combustible material 27 is introduced into the intense fluidizing region 19 with the circulating flow, and sufficiently combusted in an oxidizing atmosphere with a large amount of oxygen while the combustible material 27 moves upwardly with the upward flow 22 in the intense fluidizing region 19. The combustible material 27 is combusted in a combination of such reducing and oxidizing atmospheres, thus discharging emission gases with improved qualities, e.g., reduced NOx. In an upper zone of the intense fluidizing region 19, a portion of the fluidized medium which is heated to a high temperature is turned toward the weak fluidizing region 20 where the fluidized medium descends with the descending flow 23 and transfers heat to the plate-like heat transfer units 24.

After the fluidized medium transfers heat to the plate-like heat transfer units 24, the fluidized medium which has descended is directed horizontally and circulated back into the intense fluidizing region 19.

As described above, the combustible material 27 is sufficiently combusted by the circulating flow in the weak fluidizing region 18 and the intense fluidizing region 19 which are free of the plate-like heat transfer units 24. Then, the fluidized medium heated to a high temperature by the combusted material is carried with the circulating flow into the weak fluidizing region 20 where the fluidized medium descends with the descending flow 23 and transfers heat to the plate-like heat transfer units 24. The weak fluidizing region 20, in which the plate-like heat transfer units 24 are provided, has an oxidizing atmosphere because the fluidized medium in which the combustible material has sufficiently been combusted in the intense fluidizing region 19 flows into the weak fluidizing region 20. Therefore, the plate-like heat transfer units 24 are not subject to corrosion in a reducing atmosphere. Since the plate-like heat transfer units 24 are provided in the weak fluidizing region 20, they are not subject to undue wear which would otherwise be caused by exposure to the intense fluidizing region 19.

The incombustible material contained in the supplied solid material is discharged from the incombustible material discharge port 28 before reaching the plate-like heat transfer units 24 because the intense fluidizing region 19 and the incombustible material discharge port 28 are provided between the combustible supply port and the plate-like heat transfer units 24. Even if some incombustible material happens to reach the plate-like heat transfer units 24, since each of the plate-like heat transfer units 24 is of a planar shape, the incombustible material which may be in the form of wires is not liable to be entangled with the plate-like heat transfer units 24. The fluidized-bed furnace 1 can therefore operate continuously without malfunction. Consequently, the fluidized-bed furnace 1 of the present invention can be used to combust industrial wastes and to recover thermal energy from industrial wastes such as tires which have heretofore been impossible to process for the recovery of thermal energy.

Figure 2:
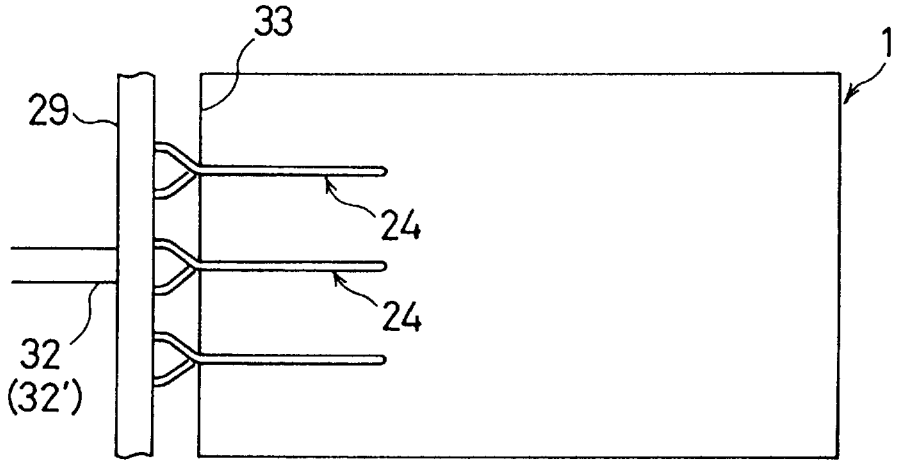
FIG. 2 is a cross-sectional view taken along line II—II of FIG. 1.

As shown in FIGS. 1 and 2, the plate-like heat transfer units 24 are mounted at outer ends thereof on vertically spaced upper and lower headers 29, 29' and inserted through the side wall 33 into the fluidized-bed furnace 1. An upper pipe 30 which defines an upper header outlet 32 is connected to the upper header 29, whereas a lower pipe 31 which defines a lower header inlet 32' is connected to the lower header 29'. Saturated water which is usually used as a medium for recovering thermal energy is introduced from the lower header inlet 32' into the lower header 29', and the water flows through the plate-like heat transfer units 24. After the water collects heat and evaporates in the plate-like heat transfer units 24, a mixture of steam and water flows into the upper header 29, and is discharged through the upper header outlet 32.

Figure 3:
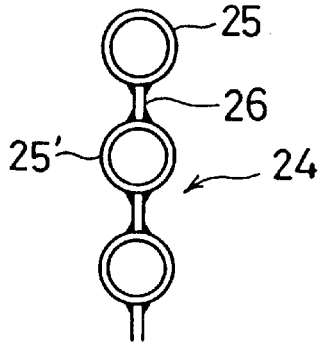
FIG. 3 is a cross-sectional view taken along line III—III of FIG. 1.
Figure 4:
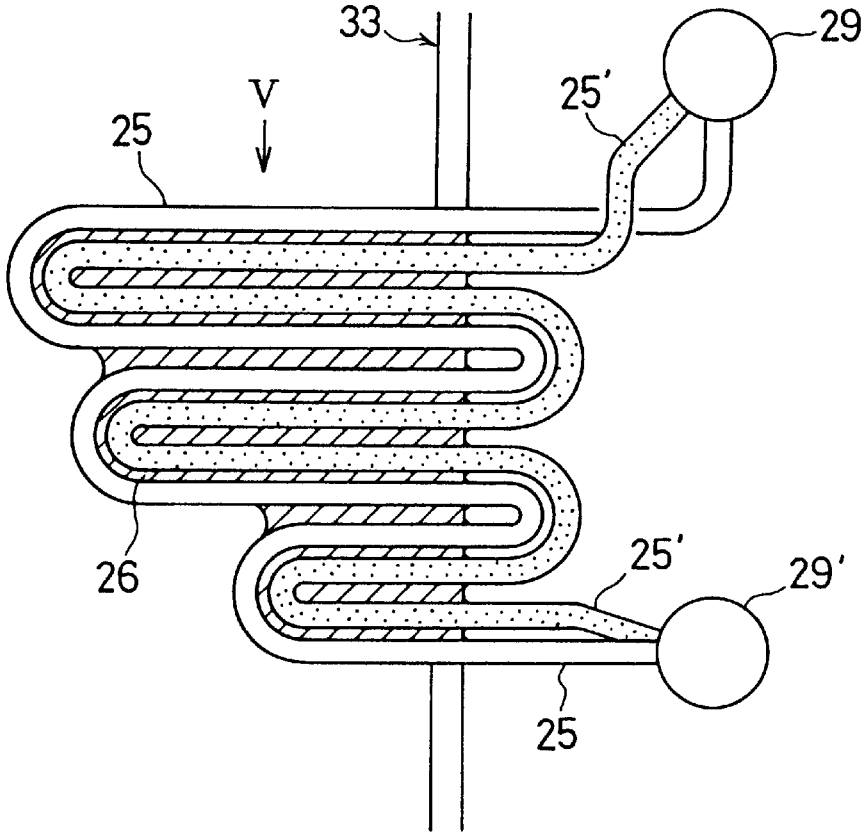
FIG. 4 is a side elevational view of a specific structure of a or plate-shaped heat transfer unit of the fluidized-bed reactor according to the first embodiment.
Figure 5:
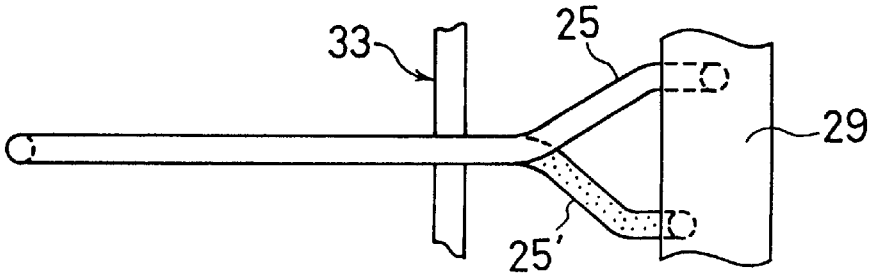
FIG. 5 is a plan view of the plate-like heat transfer unit as viewed in the direction indicated by the arrow V in FIG. 4.

As shown in FIGS. 3 and 4, each of the plate-like heat transfer units 24 comprises a pair of adjacent heat transfer tubes 25 and 25' extending in turns parallel to each other and joined to each other by fins 26. The heat transfer tubes 25 and 25' have respective opposite ends connected to the upper and lower headers 29 and 29'. The plate-like heat transfer units 24 thus constructed have a wide surface area available for heat transfer. Since each of the heat transfer tubes 25 and 25' may be of a relatively small length, any pressure loss therein is relatively small. If a surface area available for heat transfer remains constant and a circulation pump used with the plate-like heat transfer units 24 has the same output power, then the number of plate-like heat transfer units 24 which provide such a surface area may greatly be reduced. As shown in FIGS. 2 and 5, the heat transfer tubes 25 and 25' thus joined to each other by fins 26 jointly make up a single planar structure which lies vertically and extends through the side wall 33.

Figure 6:
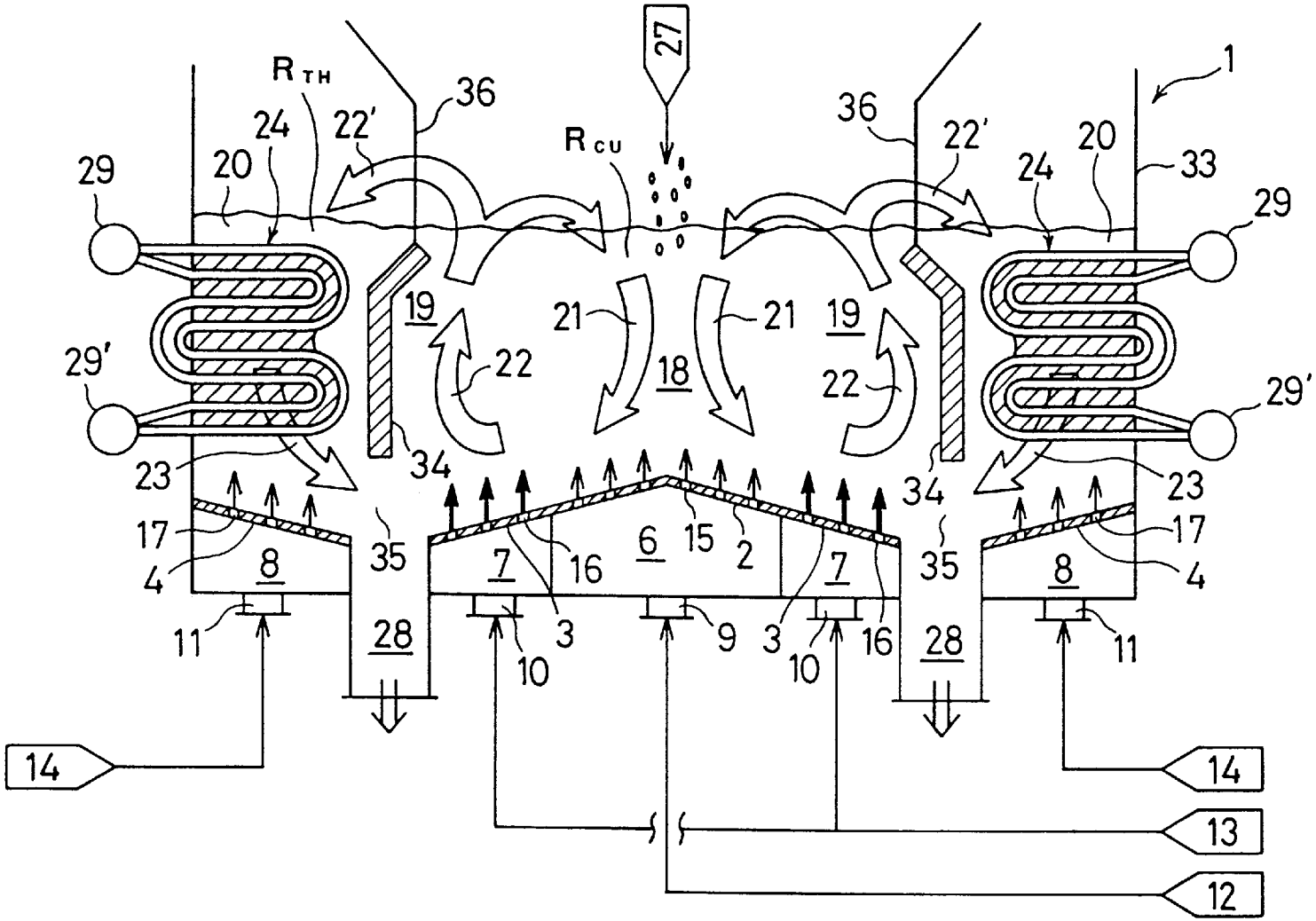
FIG. 6 is a vertical cross-sectional view of a fluidized-bed reactor according to a second embodiment of the present invention.

FIG. 6 shows a fluidized-bed combustion apparatus according to a second embodiment of the present invention.

As shown in FIG. 6, the fluidized-bed combustion apparatus according to the second embodiment comprises a fluidized-bed furnace 1 which houses a central first diffuser plate 2, a second diffuser plate 3 positioned outwardly of and joined to the first diffuser plate 2, and a third diffuser plate 4 spaced horizontally from the second diffuser plate 3. The first diffuser plate 2 has a downwardly inclined upper surface which, in vertical cross section, is highest at its center and progressively lower toward the second diffuser plate 3. The fluidized-bed furnace 1 has a polygonal or cylindrical vertical side wall 33 extending upwardly, and thus the fluidized-bed furnace 1 has a rectangular or circular shape when viewed in plan. An incombustible material discharge port 28 is defined between the second diffuser plate 3 and the third diffuser plate 4. The third diffuser plate 4, and the first and second diffuser plates 2 and 3 are inclined downwardly toward the incombustible material discharge port 28. Fluidizing gas chambers 6, 7 and 8 are provided below the first and second diffuser plates 2 and 3, and the third diffuser plates 4, respectively. Connectors 9, 10 and 11 are connected to the fluidizing gas chambers 6, 7 and 8, respectively for introducing fluidizing gas 12, 13 and 14 therethrough into the fluidizing gas chambers 6, 7 and 8.

If the fluidized-bed furnace 1 is of a rectangular shape, then the first diffuser plate 2, the second diffuser plate 3, the incombustible discharge port 28, and the third diffuser plate 4, which are of a rectangular shape, may be disposed parallel to each other, or alternatively, the second diffuser plate 3, the incombustible material discharge port 28 and the third diffuser plate 4, which are of a rectangular shape, may be disposed symmetrically with respect to a ridge of the first diffuser plate 2 which is of a rectangular, roof-shaped structure. If the fluidized-bed furnace 1 is of a circular shape, then the circular bottom of the fluidized-bed furnace is composed of the first diffuser plate 2 which is of a conical shape having a central region higher than a circumferential edge thereof, the second diffuser plate 3 which is of an annular shape disposed concentrically with the first diffuser plate 2, the incombustible material discharge port 28 comprising a plurality of arcuate sections disposed concentrically with the first diffuser plate 2, and the third diffuser plate 4 which is of an annular shape disposed concentrically with the first diffuser plate 2.

The first diffuser plate 2 has a plurality of nozzles 15 defined therein which communicate with the gas chamber 6 and are open toward a fluidizing region of the fluidized medium. The second diffuser plate 3 has a plurality of nozzles 16 defined therein which communicate with the gas chambers 7 and are open toward a fluidizing region of the fluidized medium. The third diffuser plate 4 has a plurality of nozzles 17 defined therein which communicate with the gas chambers 8 and are open toward a fluidizing region of the fluidized medium.

The fluidizing gas in the fluidizing gas chamber 6 is supplied through a number of nozzles 15 defined in the first diffuser plate 2 into the fluidized-bed furnace 1 at a relatively low fluidizing gas velocity, thus forming a weak fluidizing region 18 of the fluidized medium above the first diffuser plate 2. In the weak fluidizing region 18, the fluidized medium produces a descending flow 21. The fluidizing gas in the fluidizing gas chamber 8 is supplied through a number of nozzles 17 defined in the third diffuser plate 4 into the fluidized-bed furnace 1 at a relatively low fluidizing gas velocity, thus forming a weak fluidizing region 20 of the fluidized medium above the third diffuser plate 4. In the weak fluidized-bed region 20, the fluidized medium produces a descending flow 23. The fluidizing gas in the fluidizing gas chamber 7 is supplied through a number of nozzles 16 defined in the second diffuser plate 3 into the fluidized-bed furnace 1 at a relatively high fluidizing gas velocity, thus forming an intense fluidizing region 19 of the fluidized medium above the second diffuser plate 3. In the intense fluidizing region 19, the fluidized medium produces an upward flow 22.

A thermal energy recovery device for recovering thermal energy from the fluidized bed is disposed in the weak fluidizing regions 20 above the third diffuser plate 4. The thermal energy recovery device comprises a plurality of horizontally spaced, plate-like heat transfer units 24, each of which extends vertically. The plate-like heat transfer units 24 are identical to those of the first embodiment shown in FIGS. 1 through 5.

A partition wall 34 is vertically disposed between the intense fluidizing region 19 and the weak fluidizing region 20. Communication ports 36, 35 are defined above and below the partition wall 34 to provide communication between the intense fluidizing region 19 and the weak fluidizing region 20. The partition wall 34 partitions the interior space of the fluidized-bed furnace 1 into a thermal energy recovery chamber $R_{TH}$ which houses the plate-like heat transfer units 24, and a main combustion chamber $R_{CU}$ which is free of the plate-like heat transfer units 24. The thermal energy recovery chamber $R_{TH}$ is defined above the third diffuser plate 4 between the side wall 33 and the partition wall 34, and the main combustion chamber $R_{CU}$ is defined above the first and second diffuser plates 2 and 3 within the partition wall 34.

In the main combustion chamber $R_{CU}$, a descending flow 21 of the fluidized medium is developed in the weak fluidizing region 18, and an upward flow 22 of the fluidized medium is developed in the intense fluidizing region 19. As a result, a continuous circulating flow which moves upwardly in the intense fluidizing region 19 and downwardly in the weak fluidizing region 18 is created in the main combustion chamber $R_{CU}$.

In the vicinity of the upper end of the partition wall 34, the upward flow 22 is divided into a flow directed toward the weak fluidizing region 18 in the main combustion chamber $R_{CU}$ and a reverse flow 22' directed over the upper end of the partition wall 34 through the communication port 36 toward the thermal energy recovery chamber $R_{TH}$. Since the weak fluidizing region 20 is formed in the thermal energy recovery chamber $R_{TH}$ by the fluidizing gas supplied from the third diffuser plate 4, the fluidized medium which is introduced into the thermal energy recovery chamber $R_{TH}$ descends with the descending flows 23, and is circulated back into the main combustion chamber $R_{CU}$ through the communication port 35.

By adjusting the amount of the circulated fluidized medium and the coefficient of heat transfer to the plate-like heat transfer units 24 through a change in the fluidizing speed of the fluidized medium in the thermal energy recovery chamber $R_{TH}$, the recovery of thermal energy from the fluidized medium can be adjusted.

When a combustible material 27 is supplied from a supply port (not shown) downwardly into the weak fluidizing region 18 in the main combustion chamber $R_{CU}$, the combustible material 27 is introduced into the weak fluidizing region 18 with the descending flow 21, and thermally decomposed and combusted in a reducing atmosphere with a small amount of oxygen in the weak fluidizing region 18. Then, the combustible material 27 is introduced into the intense fluidizing region 19 with the circulating flow, and sufficiently combusted in an oxidizing atmosphere with a large amount of oxygen while the combustible material 27 moves upwardly with the upward flow 22 in the intense fluidizing region 19. In the vicinity of the upper end of the partition wall 34, the upward flow 22 is divided into a flow directed toward the weak fluidizing region 18 in the main combustion chamber $R_{CU}$ and a reverse flow 22' directed over the upper end of the partition wall 34 through the communication port 36 toward the thermal energy recovery chamber $R_{TH}$.

In the thermal energy recovery chamber $R_{TH}$, the fluidized medium which is heated to a high temperature descends with the descending flow 23 and transfers heat to the plate-like heat transfer units 24. After the fluidized medium transfers heat to the plate-like heat transfer units 24, the fluidized medium which has descended is directed horizontally and circulated back into the main combustion chamber $R_{CU}$ through the communication port 35.

The weak fluidizing region 20, in which the plate-like heat transfer units 24 are provided, has an oxidizing atmosphere because the fluidized medium in which the combustible material has sufficiently been combusted in the intense fluidizing region 19 flows into the weak fluidizing region 20. Therefore, the plate-like heat transfer units 24 are not subject to corrosion in a reducing atmosphere. Since the plate-like heat transfer units 24 are provided in the weak fluidizing region 20, they are not subject to undue wear which would otherwise be caused by exposure to the intense fluidizing region 19.

Since each of the plate-like heat transfer units 24 is of a planar shape, as described above, the incombustible material contained in the combustible material 27, which may be in the form of wires, is not liable to be entangled with the plate-like heat transfer units 24. The fluidized-bed furnace 1 can therefore operate continuously without malfunction.

Figure 7A:
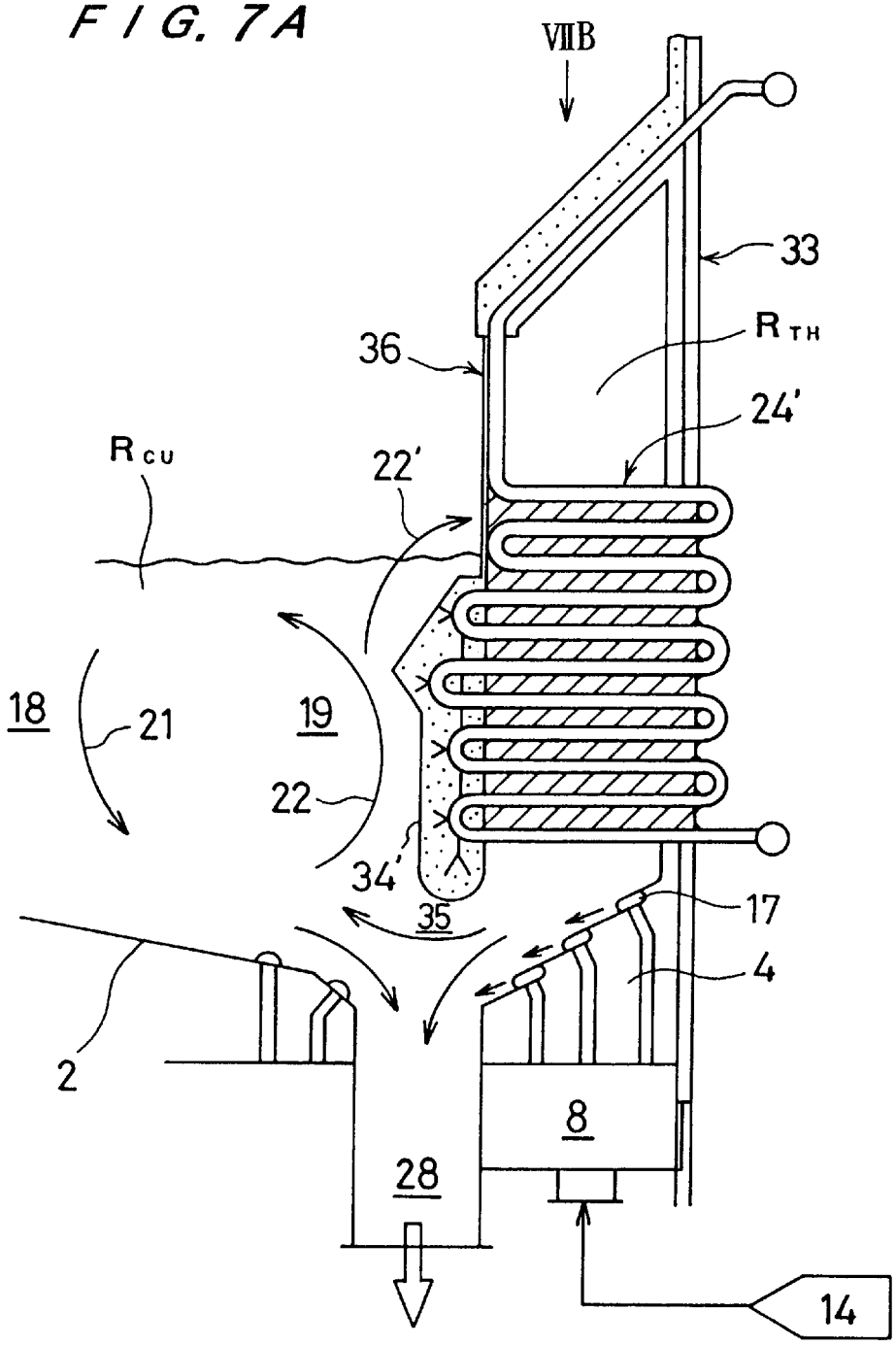
FIG. 7A is a vertical cross-sectional view of a fluidized-bed reactor according to a third embodiment of the present invention.
Figure 7B:
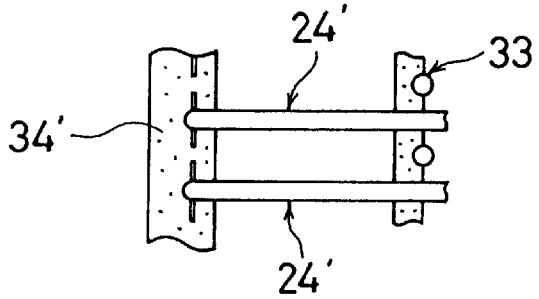
FIG. 7B is a plan view of or plate-shaped heat transfer units of the fluidized-bed reactor according to the third embodiment, as viewed in the direction indicated by the arrow VIIB in FIG. 7A.

FIGS. 7A and 7B show a fluidized-bed combustion apparatus according to a third embodiment of the present invention.

The fluidized-bed combustion apparatus according to the third embodiment differs from the fluidized-bed combustion apparatus according to the second embodiment shown in FIG. 6 in that a partition wall 34' of refractory material is integrally combined with plate-like heat transfer units 24'. The partition wall 34' is supported by the plate-like heat transfer units 24' which are fixedly mounted on a side wall 33. Other structural details of the fluidized-bed combustion apparatus according to the third embodiment are identical to those of the fluidized-bed combustion apparatus according to the second embodiment shown in FIG. 6. Since the plate-like heat transfer units 24' support the partition wall 34', there is no obstacle in a communication port 35 below the partition wall 34'. Therefore, the incombustible material that has entered the thermal energy recovery chamber $R_{TH}$ returns to the main combustion chamber $R_{CU}$ through the communication port 35 without being obstructed. Accordingly, the fluidized-bed combustion apparatus can operate without malfunction.

Figure 8:
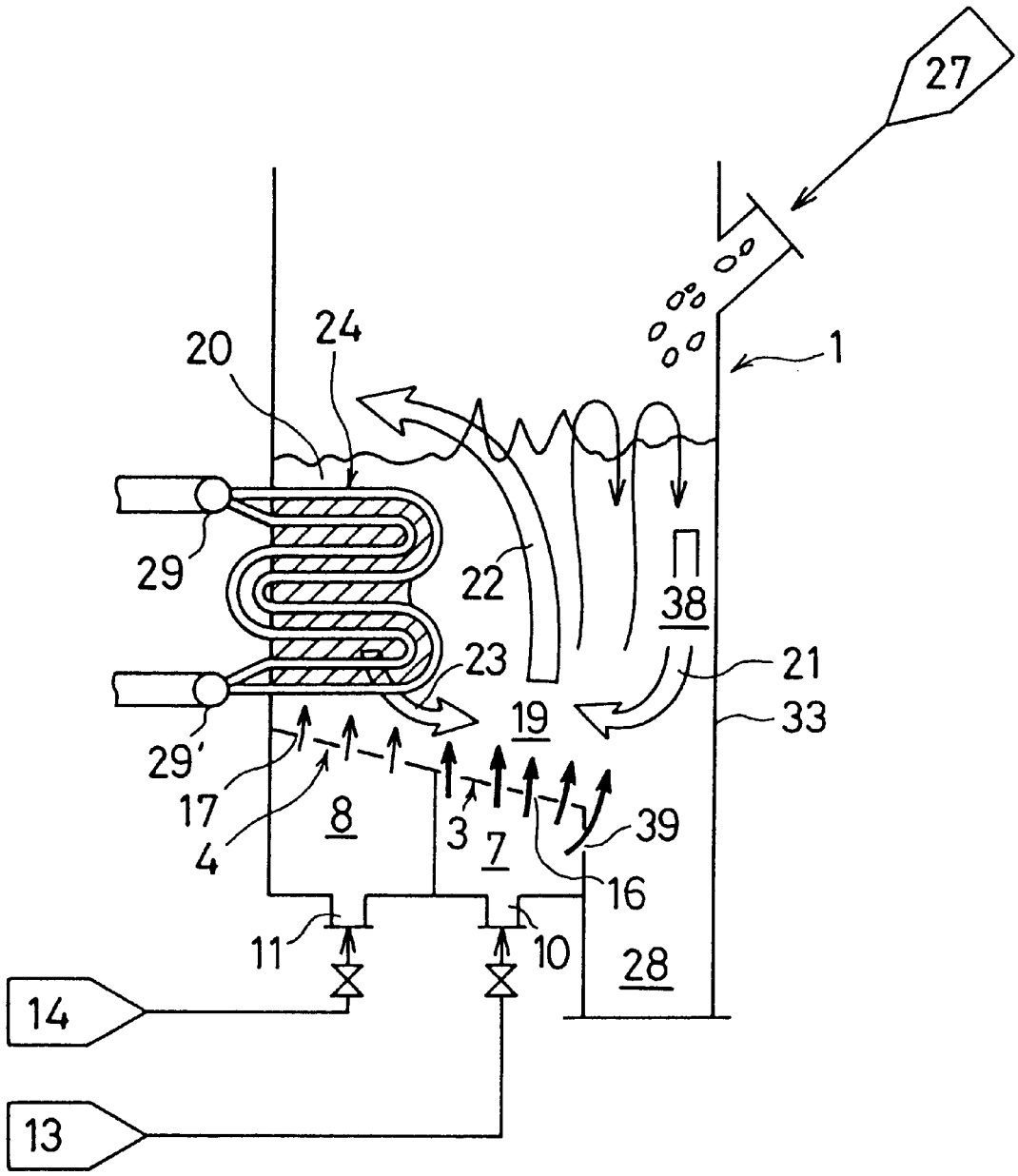
FIG. 8 is a vertical cross-sectional view of a fluidized-bed reactor according to a fourth embodiment of the present invention.

FIG. 8 shows a fluidized-bed combustion apparatus according to a fourth embodiment of the present invention.

As shown in FIG. 8, the fluidized-bed combustion apparatus according to the fourth embodiment comprises a fluidized-bed furnace 1 which houses a second diffuser plate 3 for imparting a substantially high fluidizing speed to the fluidized medium, and a third diffuser plate 4 for imparting a substantially low fluidizing speed to the fluidized medium. The third diffuser plate 4 is connected to the second diffuser plate 3. An incombustible material discharge port 28 is defined between the second diffuser plate 3 and a side wall 33 of the fluidized-bed furnace 1. The third diffuser plate 4 and the second diffuser plate 3 are inclined downwardly toward the incombustible material discharge port 28. Fluidizing gas chambers 7 and 8 are provided below the second and third diffuser plates 3 and 4, respectively. Connectors 10 and 11 are connected to the fluidizing gas chambers 7 and 8, respectively for introducing fluidizing gas 13 and 14 therethrough into the fluidizing gas chambers 7 and 8.

The second diffuser plate 3 has a plurality of nozzles 16 defined therein which communicate with the fluidizing gas chamber 7 and are open toward a fluidizing region of the fluidized medium. The third diffuser plate 4 has a plurality of nozzles 17 defined therein which communicate with the fluidizing gas chamber 8 and are open toward a fluidizing region of the fluidized medium.

In the fluidized-bed furnace 1, the fluidizing gas 14 is supplied from the fluidizing gas chamber 8 through the nozzles 17 in the third diffuser plates 4 into the fluidized bed at a relatively low fluidizing gas velocity, thus forming a weak fluidizing region 20 of the fluidized medium above the third diffuser plate 4 in the fluidized-bed furnace 1. The fluidizing gas 13 is supplied from the fluidizing gas chamber 7 through the nozzles 16 in the second diffuser plate 3 into the fluidized bed at a relatively high fluidizing gas velocity, thus forming an intense fluidizing region 19 above the second diffuser plate 3 in the fluidized-bed furnace 1. At this time, a descending flow 23 of the fluidized medium is developed in the weak fluidizing region 20, and an upward flow 22 of the fluidized medium is developed in the intense fluidizing region 19. As a result, a circulating flow in which the fluidized medium moves upwardly in the intense fluidizing region 19 and downwardly in the weak fluidizing region 20 is created in the fluidized bed.

A thermal energy recovery device for recovering thermal energy from the fluidized-bed is disposed in the weak fluidizing region 20 above the third diffuser plate 4. The thermal energy recovery device comprises a plurality of horizontally spaced, parallel plate-like heat transfer units 24, each of which extends vertically.

The fluidizing gas 13 is introduced from the fluidizing gas chamber 7 through nozzles 39 defined in a side wall of the fluidizing gas chamber 7 into the incombustible material discharge port 28 which is provided adjacent to the second diffuser plate 3. The fluidizing gas 13 which is introduced through the nozzles 39 into the incombustible material discharge port 28 serves to form a weak fluidizing region 38 of the fluidized medium above the incombustible material discharge port 28.

When a combustible material 27 is supplied from a supply port (not shown) downwardly into the weak fluidizing region 38, the combustible material 27 is introduced into the weak fluidizing region 38 with the descending flow 21, and thermally decomposed and combusted in a reducing atmosphere with a small amount of oxygen in the weak fluidizing region 18. Then, the combustible material 27 is introduced into the intense fluidizing region 19 with the circulating flow, and sufficiently combusted in an oxidizing atmosphere with a large amount of oxygen while the combustible material 27 moves upwardly with the upward flow 22 in the intense fluidizing region 19. The combustible material 27 is combusted in a combination of such reducing and oxidizing atmospheres, thus discharging emission gases with improved qualities, e.g., reduced NOx. In an upper zone of the intense fluidizing region 19, a portion of the fluidized medium which is heated to a high temperature is turned toward the weak fluidizing region 20 where the fluidized medium descends with the descending flow 23 and transfers heat to the plate-like heat transfer units 24.

After the fluidized medium transfers heat to the plate-like heat transfer units 24, the fluidized medium which has descended is directed horizontally and circulated back into the intense fluidizing region 19. At this time, most of the incombustible material contained in the fluidized medium is settled down and discharged through the incombustible material discharge port 28.

The weak fluidizing region 20, in which the plate-like heat transfer units 24 are provided, has an oxidizing atmosphere because the fluidized medium in which the combustible material has sufficiently been combusted in the intense fluidizing region 19 flows into the weak fluidizing region 20. Therefore, the plate-like heat transfer units 24 are not subject to corrosion in a reducing atmosphere. Since the plate-like heat transfer units 24 are provided in the weak fluidizing region 20, they are not subject to undue wear which would otherwise be caused by exposure to the intense fluidizing region 19.

Since each of the plate-like heat transfer units 24 is of a planar shape, as described above, the incombustible material contained in the combustible material 27, which may be in the form of wires, is not liable to be entangled with the plate-like heat transfer units 24. The fluidized-bed furnace 1 can therefore operate continuously without malfunction.

Figure 9:
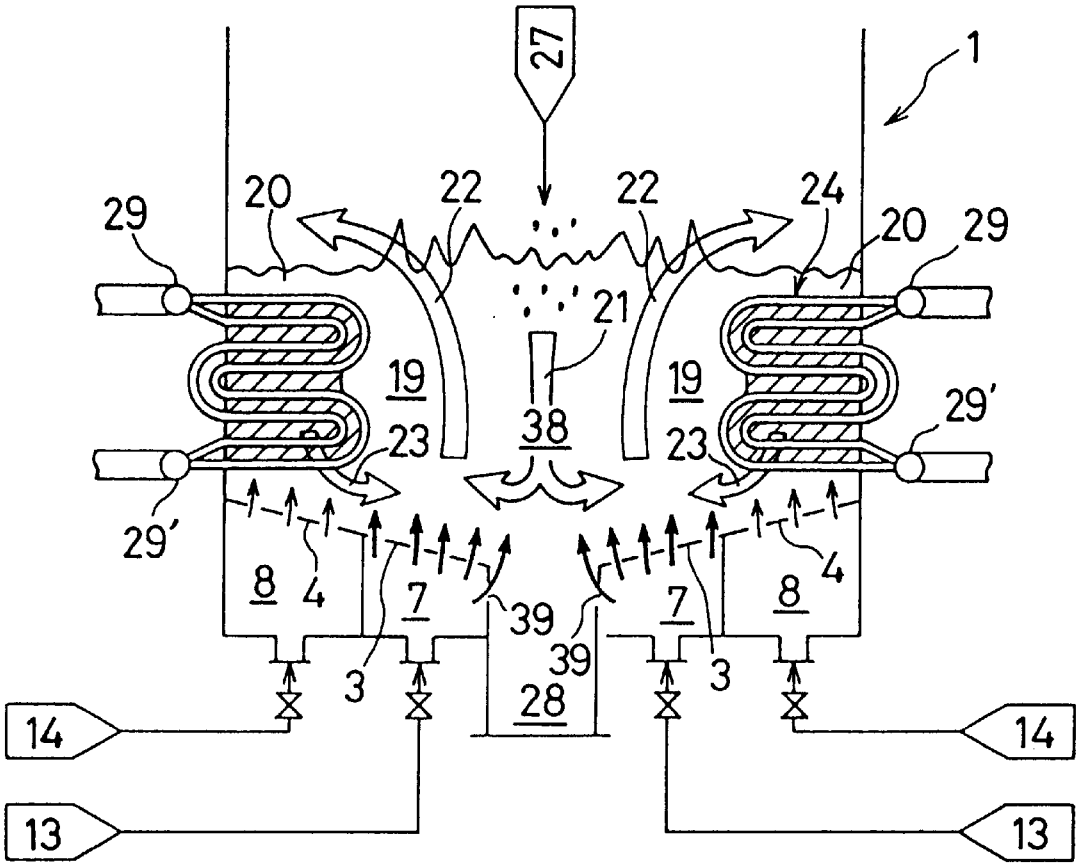
FIG. 9 is a vertical cross-sectional view of a fluidized-bed reactor according to a fifth embodiment of the present invention.

FIG. 9 shows a fluidized-bed combustion apparatus according to a fifth embodiment of the present invention.

The fluidized-bed combustion apparatus according to the fifth embodiment has such a structure that a pair of fluidized-bed furnaces 1, each having a structure shown in FIG. 9, are joined to each other symmetrically with respect to the incombustible material discharge port 28 positioned at the center of the furnace.

Specifically, as shown in FIG. 9, the fluidized-bed combustion apparatus has third diffuser plates 4, and second diffuser plates 3 connected to the third diffuser plates 4. An incombustible material discharge port 28 is defined between the second diffuser plates 3. The thermal energy recovery device comprising a plurality of horizontally spaced, parallel plate-like heat transfer units 24, is disposed in the weak fluidizing regions 20 above the third diffuser plate 4. A combustible material 27 is supplied from a supply port (not shown) into a weak fluidizing region 38 above the incombustible material discharge port 28.

The fluidized-bed combustion apparatus according to the fifth embodiment operates in the same manner as the fluidized-bed combustion apparatus according to the fourth embodiment shown in FIG. 8.

In the embodiments shown in FIGS. 1 through 9, although the first, second and third diffuser plates 2, 3 and 4 are illustrated as being inclined downwardly toward the incombustible material discharge port 28, the first, second and third diffuser plates 2, 3 and 4 may lie horizontally.

Figure 10:
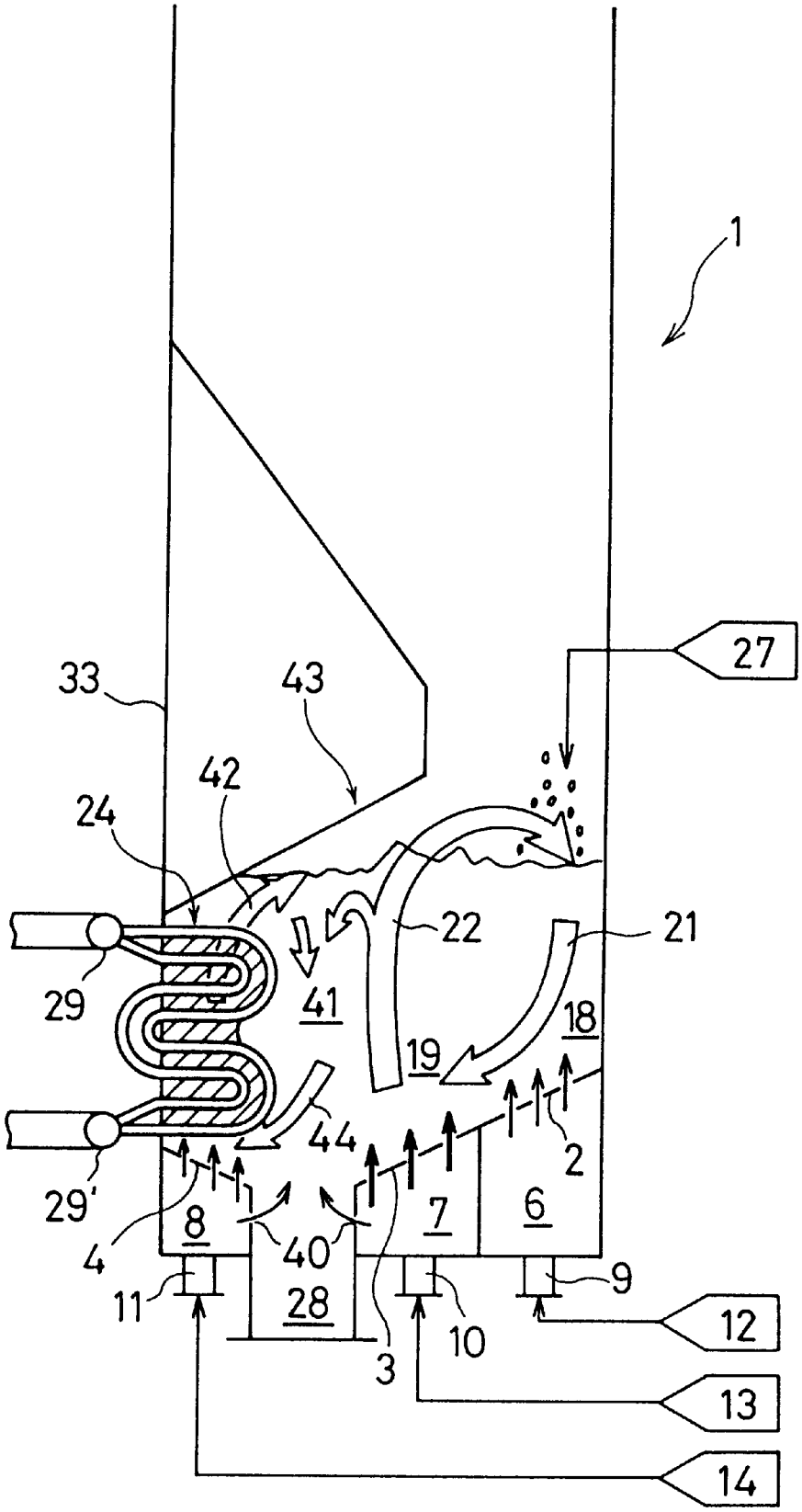
FIG. 10 is a vertical cross-sectional view of a fluidized-bed reactor according to a sixth embodiment of the present invention.

FIG. 10 shows a fluidized-bed combustion apparatus according to a sixth embodiment of the present invention.

The fluidized-bed combustion apparatus according to the sixth embodiment is of basically the same structure as the fluidized-bed combustion apparatus according to the first embodiment shown in FIG. 1, except that an upward flow is developed in a region where the plate-like heat transfer units 24 are provided.

Specifically, as shown in FIG. 10, the fluidizing gas is introduced from the fluidizing gas chambers 7 and 8 through nozzles 40 defined in side walls of the fluidizing gas chambers 7 and 8 into the incombustible material discharge port 28, thereby forming a weak fluidizing region 41 of the fluidized medium in which the fluidized medium is fluidized at a substantially low fluidizing speed. An inclined wall 43 extends inwardly from the side wall 33 in overhanging relation to the third diffuser plate 4 and the incombustible material discharge port 28 to a position above the second diffuser plate 3. The inclined wall 43 serves to deflect the fluidized medium which moves upwardly toward the weak fluidizing region 41 above the incombustible material discharge port 28.

Specifically, the plate-like heat transfer units 24 are provided in a region in which the fluidized medium is fluidized at a higher fluidizing speed than that in the weak fluidizing region 41, thereby developing an upward flow 42 of the fluidized medium which is directed by the inclined wall 43 toward the weak fluidizing region 41. In the weak fluidizing region 41, a descending flow 44 of the fluidized medium is developed. The descending flow 44 of the fluidized medium has a lowest fluidizing speed, the upward flow 42 of the fluidized medium has an intermediate fluidizing speed, and the upward flow 22 of the fluidized medium has a highest fluidizing speed.

Figure 11:
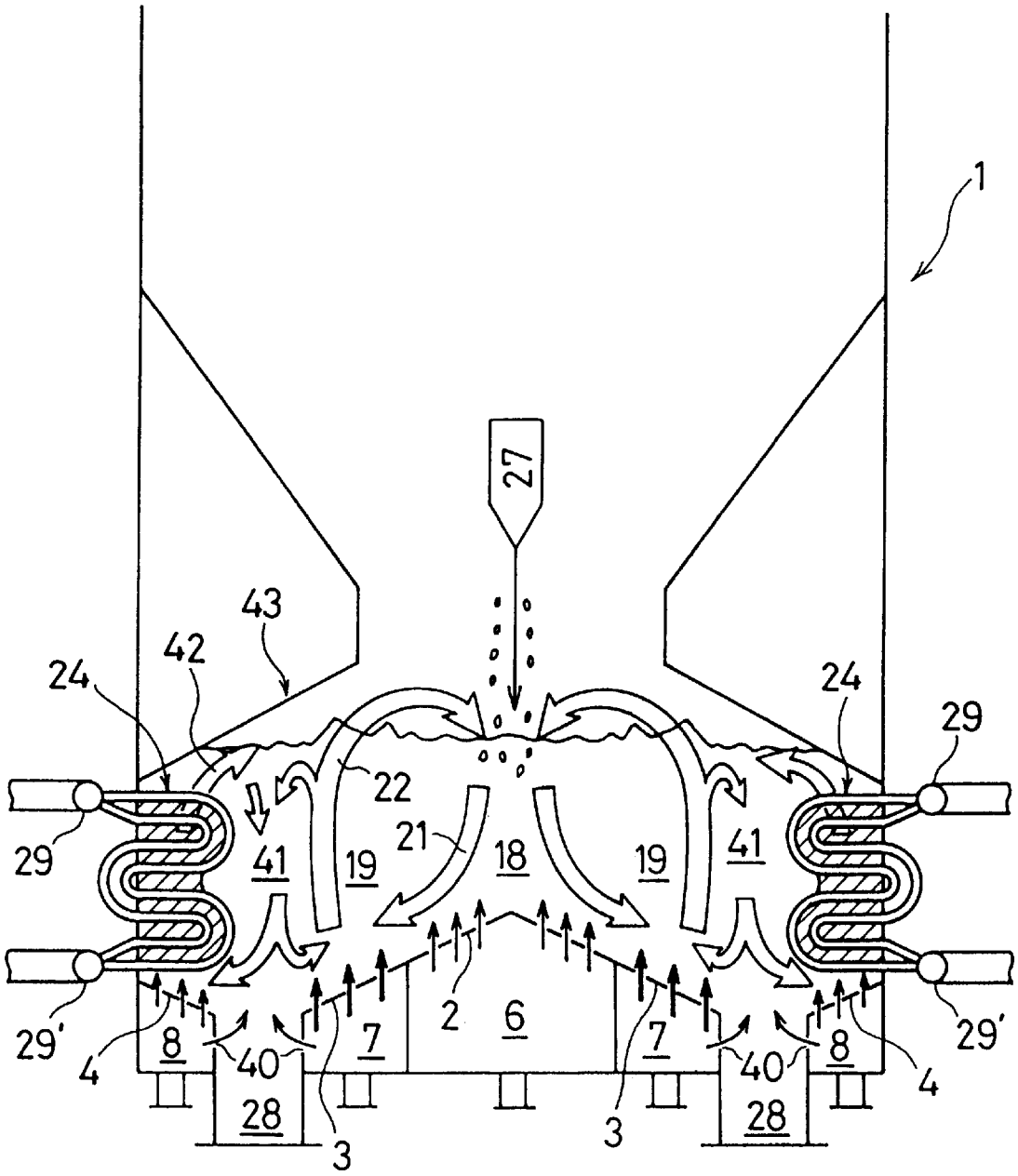
FIG. 11 is a vertical cross-sectional view of a fluidized-bed reactor according to a seventh embodiment of the present invention.

FIG. 11 shows a fluidized-bed combustion apparatus according to a seventh embodiment of the present invention.

According to the seventh embodiment, the fluidized-bed combustion apparatus has such a structure that a pair of fluidized-bed furnaces, each having a structure shown in FIG. 10, are joined to each other symmetrically with respect to the fluidizing gas chamber 6 positioned at the center of the furnace. The fluidized-bed combustion apparatus according to the seventh embodiment is functionally identical to the fluidized-bed combustion apparatus according to the sixth embodiment shown in FIG. 10, and will not be described in detail below.

Figure 12:
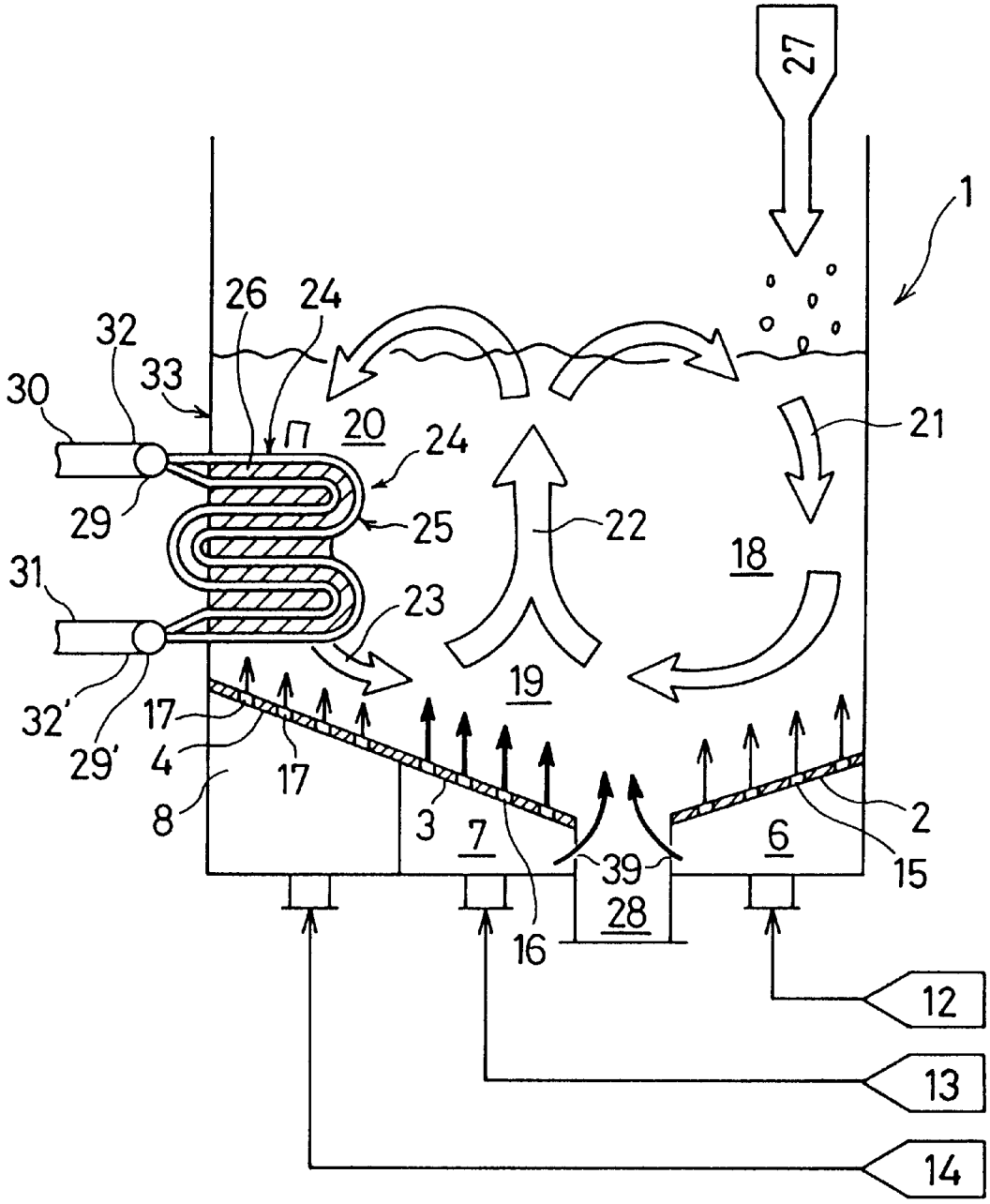
FIG. 12 is a vertical cross-sectional view of a fluidized-bed reactor according to an eighth embodiment of the p resent invention.

FIG. 12 shows a fluidized-bed combustion apparatus according to an eighth embodiment of the present invention.

The fluidized-bed combustion apparatus according to the eighth embodiment has a third diffuser plate 4 disposed adjacent to and extending from a side wall 33, a second diffuser plate 3 connected to the third diffuser plate 4, and a first diffuser plate 2 horizontally spaced from the second diffuser plate 3. An incombustible material discharge port 28 is defined between the first and second diffuser plates 2 and 3. Fluidizing gas chambers 6, 7 and 8 are defined below the first, second and third diffuser plates 2, 3 and 4, respectively. The fluidizing gas is introduced from the fluidizing gas chambers 6 and 7 through nozzles 39 defined in side walls of the fluidizing gas chambers 6 and 7 into the incombustible material discharge port 28. Other details of the fluidized-bed combustion apparatus according to the eighth embodiment are identical to those of the fluidized-bed combustion apparatus according to the first embodiment shown in FIG. 1.

When a combustible material 27 is supplied from a supply port (not shown) downwardly into the weak fluidizing region 18, the combustible material 27 is introduced into the weak fluidizing region 18 with the descending flow 21, and thermally decomposed and combusted in a reducing atmosphere with a small amount of oxygen in the weak fluidizing region 18. Then, the combustible material 27 is carried with the circulating flow to a position above the incombustible material discharge port 28. Since an intense fluidizing region is developed above the incombustible material discharge port 28 by the fluidizing gas introduced from the nozzles 39, the incombustible material contained in the combustible material 27 falls into the incombustible material discharge port 28 and is discharged therefrom. When the fluidized medium which contains a reduced concentration of the incombustible material reaches the intense fluidizing region 19 above the second diffuser plate 3, the fluidized medium moves upwardly with the upward flow 22, and is then turned toward the weak fluidizing region 20 in which the plate-like heat transfer units 24 are provided. Since the concentration of the incombustible material in the fluidized medium has been reduced, the plate-like heat transfer units 24 are less susceptible to clogging caused by the incombustible material than that of the fluidized-bed combustion apparatus according to the first embodiment shown in FIG. 1.

Figure 13:
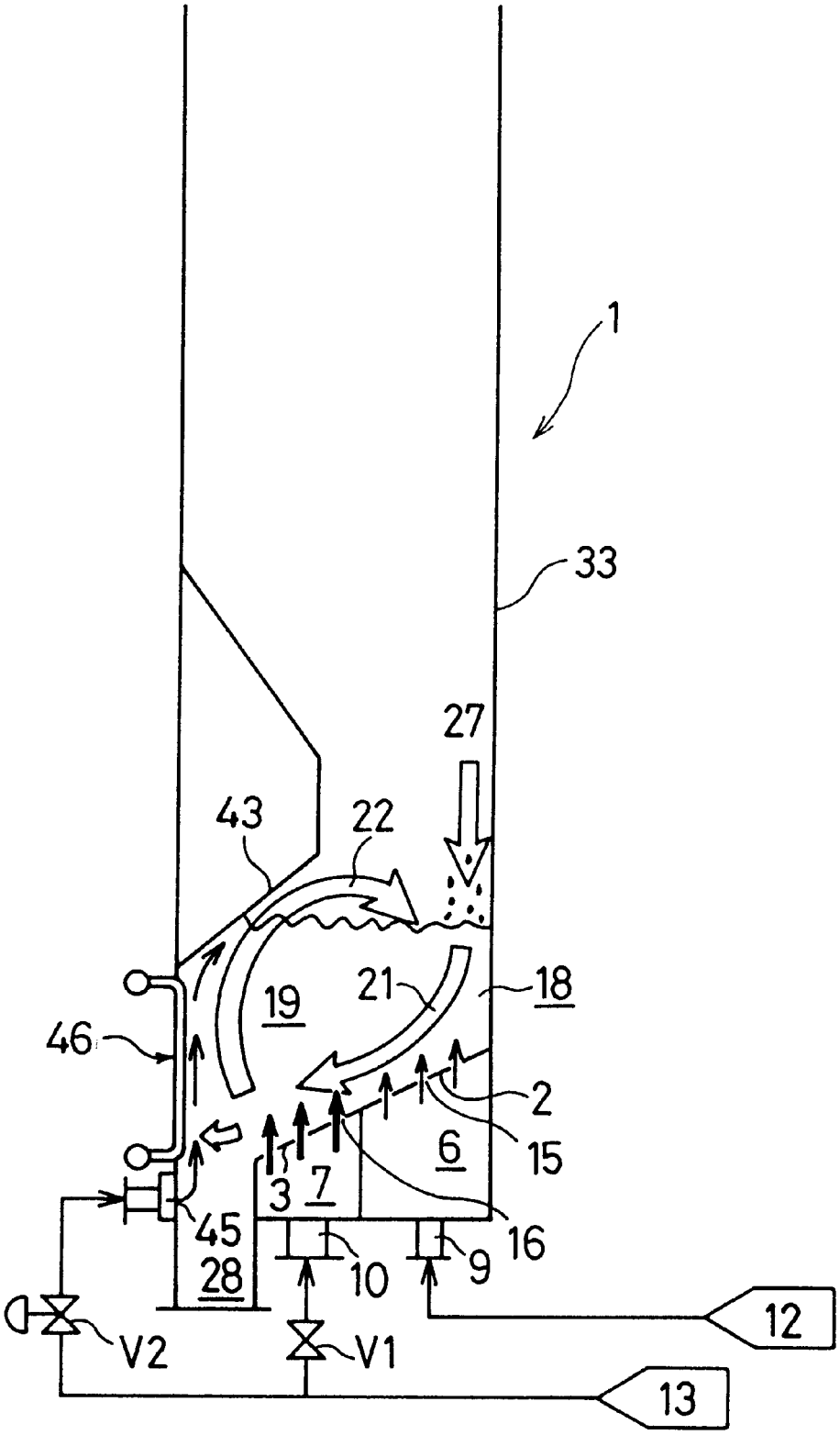
FIG. 13 is a vertical cross-sectional view of a fluidized-bed reactor according to a ninth embodiment of the present invention.

FIG. 13 shows a fluidized-bed combustion apparatus according to a ninth embodiment of the present invention.

As shown in FIG. 13, the fluidized-bed combustion apparatus according to the ninth embodiment comprises a fluidized-bed furnace 1 which houses a first diffuser plate 2 for imparting a substantially low fluidizing speed to the fluidized medium, and a second diffuser plate 3 for imparting a substantially high fluidizing speed to the fluidized medium. The first diffuser plate 2 is connected to the second diffuser plate 3, which is spaced horizontally from a side wall 33. An incombustible material discharge port 28 is defined between the second diffuser plate 3 and the side wall 33. The first and second diffuser plates 2 and 3 are inclined downwardly toward the incombustible material discharge port 28. Fluidizing gas chambers 6 and 7 are defined below the first and second diffuser plates 2 and 3, respectively. Nozzles 45 are defined in the side wall 33 and open into an upper portion of the incombustible material discharge port 28 for ejecting fluidizing gas into the incombustible material discharge port 28. A connector 9 is connected to the fluidizing gas chamber 6 for introducing fluidizing gas 12 into the fluidizing gas chamber 6, and a connector 10 is connected to the fluidizing gas chamber 7 for introducing fluidizing gas 13 through a valve V1 into the fluidizing gas chamber 7. The fluidizing gas 13 is also supplied to the nozzles 45 through a valve V2.

The fluidizing gas 12 is introduced from the fluidizing gas chamber 6 through nozzles 15 defined in the first diffuser plate 2 into the fluidized bed at a relatively low fluidizing gas velocity, thereby forming a weak fluidizing region 18 of the fluidized medium above the first diffuser plate 2. The fluidizing gas 13 is introduced from the fluidizing gas chamber 7 through nozzles 16 defined in the second diffuser plate 3 into the fluidized bed at a relatively high fluidizing gas velocity, thereby forming an intense fluidizing region 19 above the second diffuser plate 3. At this time, a descending flow 21 of the fluidized medium is developed in the weak fluidizing region 18, and an upward flow 22 of the fluidized medium is developed in the intense fluidizing region 19. The upward flow 22 of the fluidized medium is deflected by the inclined wall 43 toward the weak fluidizing region 18. As a result, a circulating flow in which the fluidized medium moves upwardly in the intense fluidizing region 19 and downwardly in the weak fluidizing region 18 is created in the fluidized bed.

The fluidizing gas 13 is also introduced from the nozzles 45 into the upper portion of the incombustible material discharge port 28, thus forming an upward flow of the fluidized medium in the intense fluidizing region 19. A or plate or panel shaped heat transfer unit 46 is formed as a wall surface of the side wall 33 alongside of the intense fluidizing region 19.

Since the plate-like heat transfer unit 46 is of a planar shape and serves as a wall surface without inward projection into the intense fluidizing region 19, the incombustible material contained in the combustible material 27 which may be in the form of wires is prevented from being entangled with the plate-like heat transfer units 46. Therefore, the fluidized-bed combustion apparatus can operate without malfunction.

Figure 14:
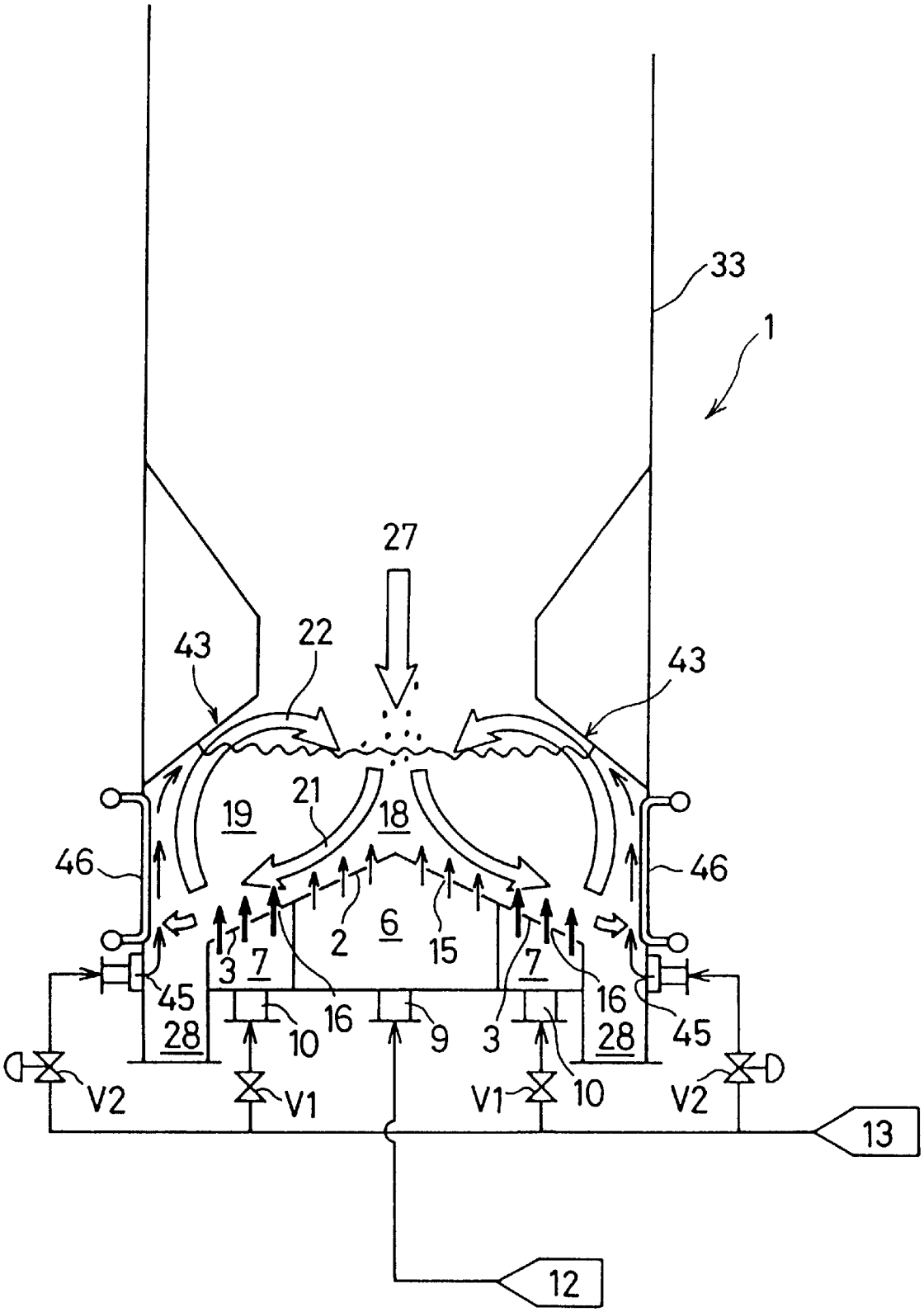
FIG. 14 is a vertical cross-sectional view of a fluidized-bed reactor according to a tenth embodiment of the present invention.

FIG. 14 shows a fluidized-bed combustion apparatus according to a tenth embodiment of the present invention.

According to the tenth embodiment, the fluidized-bed combustion apparatus has such a structure that a pair of fluidized-bed furnaces, each having a structure shown in FIG. 13, are joined to each other symmetrically with respect to the fluidizing gas chamber 6 positioned at the center of the furnace. The fluidized-bed combustion apparatus according to the tenth embodiment is functionally identical to the fluidized-bed combustion apparatus according to the ninth embodiment shown in FIG. 13, and will not be described in detail below.

In the embodiments described above, although a fluidized-bed combustion apparatus has been described as one example of the fluidized-bed reactor, the present invention is applicable to a gasifying apparatus for producing gas from solid material containing combustible material and incombustible material. In this case, the structure of the apparatus is identical to those shown in FIGS. 1 through 14, except for an oxygen flow rate in the fluidizing gas is less than a stoichiometric oxygen flow rate necessary for combusting combustible material supplied to the furnace.

As is apparent from the above description, the present invention offers the following advantages:

(1) In the conventional apparatus, incombustible material in the form of wires contained in waste material tends to be deposited in the fluidized bed and to be entangled with heat transfer tubes, and hence fluidization of the fluidized medium is not carried out smoothly, resulting in malfunction of the furnace. No effective process for recovering energy has heretofore been available for industrial wastes including incombustible material in the form of wires, such as waste tires. However, according to the present invention, by using the or plate or panel shaped heat transfer unit for recovering thermal energy from the fluidized-bed, the combustible material containing the incombustible material in the form of wires can be oxidized and thermal energy can be recovered without hindrance. Thus, it is possible to utilize energy recoverable from the industrial wastes which have not heretofore been utilized.

(2) The combustible material is supplied into a region having a reducing atmosphere in which a relatively low fluidizing speed is imparted to the fluidized medium, combusted in the reducing atmosphere, and then combusted in a region having an oxidizing atmosphere in which a relatively high fluidizing speed is imparted to the fluidizing medium. That is, the combustible material is combusted in a combination of such reducing and oxidizing atmospheres, thus discharging emission gases with improved qualities, e.g., reduced NOx. Further, since there is another weak fluidizing region having an oxidizing atmosphere in which the thermal energy recovery device is provided, the thermal energy recovery device is not subject to corrosion in the reducing atmosphere.

(3) The incombustible material contained in the combustible material is discharged from the incombustible material discharge port before reaching the thermal energy recovery device because the intense fluidizing region and the incombustible material discharge port are provided between the thermal energy recovery device and the combustible supply port. Even if some incombustible material happens to reach the thermal energy recovery device, since the thermal energy recovery device is of a planar shape, the incombustible material is not liable to be entangled with the thermal energy recovery device. Thus, the incombustible material returns to the incombustible material discharge port with the circulating flow, and is discharged therefrom.

(4) The plate-like heat transfer unit comprises a plurality of adjacent heat transfer tubes extending in turns parallel to each other and joined to each other by fins. The plate-like heat transfer unit thus constructed has a wide surface area available for heat transfer. Since the heat transfer tubes may be of a relatively small length, any pressure loss therein is relatively small. If a surface area available for heat transfer remains constant and a circulation pump used with the plate-like heat transfer unit has the same output power, then the number of plate-like heat transfer units which provide such a surface area may greatly be reduced. Thus, according to the present invention, it is possible to utilize energy recoverable from wastes such as waste tires which has generated incombustible material in the form of wires produced when it is combusted and has caused malfunction of the furnace.

Although certain preferred embodiments of the present invention have been shown and described in detail, it should be understood that various changes and modifications may be made therein without departing from the scope of the appended claims.

What is claimed is:

1. A fluidized-bed reactor for oxidizing combustible material containing incombustible material in a fluidized-bed furnace having a fluidized medium therein, comprising:

a plurality of fluidizing gas diffusion devices disposed at a bottom of said fluidizing-bed furnace for supplying a fluidizing gas, and for imparting different fluidizing speeds to the fluidized medium in a fluidized bed in said fluidizing-bed furnace to form an upward flow of the fluidized medium in a fluidizing region with a relatively higher fluidizing speed of the fluidizing medium and a descending flow of the fluidized medium in a fluidizing region with a relatively lower fluidizing speed of the fluidized medium; and a plate shaped thermal energy recovery device disposed in said fluidizing region with said relatively lower fluidizing speed of the fluidized medium, said plate shaped thermal energy recovery device having a heat recovery surface extending vertically.

2. A fluidized-bed reactor according to claim 1, wherein said plate shaped thermal energy recovery device comprises at least one plate shaped heat transfer unit having a plurality of heat transfer tubes lying in one plane and joined to each other by fins, said heat transfer tubes jointly providing said heat recovery surface.

3. A fluidized-bed reactor for oxidizing combustible material containing incombustible material in a fluidized-bed furnace having a fluidized medium therein, comprising:

a plurality of fluidizing gas diffusion devices disposed at a bottom of said fluidizing-bed furnace for supplying a fluidizing gas, and for imparting different fluidizing speeds to the fluidized medium in a fluidized bed in said fluidizing-bed furnace to form an upward flow of the fluidized medium in a fluidizing region with a relatively higher fluidizing speed of the fluidizing medium and a descending flow of the fluidized medium in a fluidizing region with a relatively lower fluidizing speed of the fluidized medium;

an inclined wall positioned at an upper part of said upward flow of the fluidized medium for deflecting the flow of the fluidized medium to form a descending flow of the fluidized medium in a fluidizing region with a lowest fluidizing speed of the fluidizing medium, and an upward flow of the fluidized medium in a fluidizing region with an intermediate fluidizing speed of the fluidized medium so as to produce a moderate upward flow; and a plate shaped thermal energy recovery device disposed in said fluidizing region with the intermediate fluidizing speed of the fluidized medium, said plate shaped thermal energy recovery device having a heat recovery surface extending vertically.

4. A fluidized-bed reactor according to claim 3, wherein said plate-shaped thermal energy recovery device comprises at least one plate shaped heat transfer unit having a plurality of heat transfer tubes lying in one plane and joined to each other by fins, said heat transfer tubes jointly providing said heat recovery surface.

5. A fluidized-bed reactor for oxidizing combustible material containing incombustible material in a fluidized-bed furnace having a fluidized medium therein, comprising:

a partition wall which partitions an interior space of the fluidized-bed furnace into a plurality of regions for producing a plurality of fluidized beds therein, said fluidized beds communicating with each other above and below said partition wall;

a plurality of fluidizing gas diffusion devices disposed at a bottom of said fluidizing-bed furnace for supplying a fluidizing gas, and for imparting different fluidizing speeds to the fluidized medium in a fluidized bed in said fluidizing-bed furnace to form an upward flow of the fluidized medium in a fluidizing region with a relatively higher fluidizing speed of the fluidizing medium and a descending flow of the fluidized medium in a fluidizing region with a relatively lower fluidizing speed of the fluidized medium, a part of said upward flow of the fluidized medium being introduced beyond the upper end of said partition wall into one of said fluidized beds which forms a moving bed so as to cause the fluidized medium to descend moderately, and returning through a communicating port below said partition wall to the other of said fluidized beds with the relatively higher fluidizing speed of the fluidized medium for circulation; and a plate shaped thermal energy recovery device disposed in said fluidizing bed which forms said descending moving bed.

6. A fluidized-bed reactor according to claim 5, wherein said plate shaped thermal energy recovery device comprises at least one plate shaped heat transfer unit having a plurality of heat transfer tubes lying in one plane and joined to each other by fins, said heat transfer tubes jointly providing a single heat recovery surface.

7. A fluidized-bed reactor according to claim 5, wherein said partition wall and said plate shaped thermal energy recovery device are joined integrally to each other.

8. A fluidized-bed reactor for oxidizing combustible material containing incombustible material in a fluidized-bed furnace having a fluidized medium therein, comprising:

a plurality of fluidizing gas diffusion devices disposed at a bottom of said fluidizing-bed furnace for supplying a fluidizing gas, and for imparting different fluidizing speeds to the fluidized medium in a fluidized bed in said fluidizing-bed furnace to form an upward flow of the fluidized medium in a fluidizing region with a relatively higher fluidizing speed of the fluidizing medium and a descending flow of the fluidized medium in a fluidizing region with a relatively lower fluidizing speed of the fluidized medium;

an inclined wall positioned at an upper part of said upward flow of the fluidized medium for deflecting the flow of the fluidized medium; and a plate shaped heat transfer surface provided on a side wall of said fluidized-bed furnace and extending to a lower end of said inclined wall.

9. A fluidized-bed reactor for oxidizing combustible material containing incombustible material in a fluidized-bed furnace having a fluidized medium therein, comprising:

a fluidizing gas diffusion device disposed at a bottom of said fluidized-bed furnace for supplying a fluidizing gas, and for imparting a relatively higher fluidizing speed to the fluidizing medium to form an intense fluidizing region;

fluidizing gas diffusion devices disposed at a bottom of said fluidized-bed furnace for supplying a fluidizing gas which are located one on each side of said fluidizing gas diffusion device, for imparting a relatively lower fluidizing speed to the fluidizing medium to form an weak fluidizing regions;

a thermal energy recovery device disposed in one of said weak fluidizing region, said thermal energy recovery device comprising a plate shaped thermal energy recovery device;

a supply port for supplying the combustible material into the other of said weak fluidizing regions; and an incombustible material discharge port disposed between said fluidizing gas diffusion device for imparting the relatively higher fluidizing speed to the fluidizing medium and one said fluidizing gas diffusion device for imparting the relatively lower fluidizing speed to the fluidized medium.

10. A fluidized-bed reactor according to claim 9, wherein the amount of oxygen contained in said fluidizing gas is adjusted so that said weak fluidizing region to which the combustible material is supplied has a reducing atmosphere, and said intense fluidizing region has an oxidizing atmosphere.

11. A fluidized-bed reactor according to claim 9, wherein said plate shaped thermal energy recovery device comprises at least one plate shaped heat transfer unit having a plurality of heat transfer tubes lying in one plane and joined to each other by fins, said heat transfer tubes jointly providing a single heat recovery surface.

12. A fluidized-bed reactor according to claim 6, wherein said partition wall and said plate shaped thermal energy recovery device are joined integrally to each other.

* * * * *